US006907205B2

(12) United States Patent
Himes et al.

(10) Patent No.: US 6,907,205 B2
(45) Date of Patent: Jun. 14, 2005

(54) COUPLING ARRANGEMENT INCLUDING DRUM AND FLANGE

(75) Inventors: William Himes, Suffolk, VA (US); Guerry L. Grune, Virginia Beach, VA (US)

(73) Assignee: Mitsubishi Chemical America, Inc., Chesapeake, VA (US)

( * ) Notice: Subject to any disclaimer, the term of this patent is extended or adjusted under 35 U.S.C. 154(b) by 27 days.

(21) Appl. No.: 10/448,075

(22) Filed: May 30, 2003

(65) Prior Publication Data

US 2003/0223774 A1 Dec. 4, 2003

Related U.S. Application Data

(60) Provisional application No. 60/384,107, filed on May 31, 2002.

(51) Int. Cl.[7] ..... G03G 15/00
(52) U.S. Cl. ..... 399/90; 399/117
(58) Field of Search ..... 399/90, 117, 159, 399/116

(56) References Cited

U.S. PATENT DOCUMENTS

| | | | | |
|---|---|---|---|---|
| 4,527,883 | A | | 7/1985 | Kamiyama |
| 4,833,502 | A | | 5/1989 | Azuma |
| 4,839,690 | A | | 6/1989 | Onoda et al. |
| 5,023,660 | A | | 6/1991 | Ebata et al. |
| 5,052,090 | A | | 10/1991 | Kitaura et al. |
| 5,126,800 | A | | 6/1992 | Shishido et al. |
| 5,151,734 | A | | 9/1992 | Tsuda et al. |
| 5,210,574 | A | | 5/1993 | Kita |
| 5,347,343 | A | | 9/1994 | Ohtsuka et al. |
| 5,461,464 | A | | 10/1995 | Swain |
| 5,500,714 | A | | 3/1996 | Yashiro et al. |
| 5,579,085 | A | | 11/1996 | Miyabe et al. |
| 5,594,531 | A | | 1/1997 | Shishido et al. |
| 5,599,265 | A | | 2/1997 | Foltz |
| 5,655,182 | A | | 8/1997 | Sanchez et al. |
| 5,729,792 | A | | 3/1998 | Ikehara |
| 5,739,900 | A | | 4/1998 | Isobe |
| 5,752,136 | A | * | 5/1998 | Sanchez et al. ..... 399/117 |
| 5,768,943 | A | | 6/1998 | Kawata et al. |
| 5,771,425 | A | | 6/1998 | Yamada et al. |
| 5,842,962 | A | | 12/1998 | Yamada et al. |
| 5,878,310 | A | | 3/1999 | Noda et al. |
| 5,907,750 | A | | 5/1999 | Yamada et al. |
| 5,943,527 | A | | 8/1999 | Kashiwagi et al. |
| 5,953,562 | A | | 9/1999 | Kawaguchi et al. |
| 5,991,571 | A | | 11/1999 | Yamada et al. |
| 5,999,771 | A | | 12/1999 | Wakihara |
| 6,072,968 | A | | 6/2000 | Nomura et al. |
| 6,097,909 | A | | 8/2000 | Watanabe et al. |
| 6,104,896 | A | * | 8/2000 | Zaman et al. ..... 399/117 |
| 6,167,219 | A | | 12/2000 | Miyamoto et al. |
| 6,175,706 | B1 | | 1/2001 | Watanabe et al. |
| 6,226,478 | B1 | | 5/2001 | Watanabe et al. |
| 6,240,266 | B1 | | 5/2001 | Watanabe et al. |
| 6,490,426 | B1 | * | 12/2002 | Zaman ..... 399/117 |
| 6,771,915 | B2 | * | 8/2004 | Cais et al. ..... 399/90 |

* cited by examiner

*Primary Examiner*—William J. Royer
(74) *Attorney, Agent, or Firm*—Oblon, Spivak, McClelland, Maier & Neustadt, P.C.

(57) ABSTRACT

A coupling arrangement having an optical photo-conductive drum including drum exterior and interior surfaces surrounding and extending along a longitudinal axis, the drum exterior surface facing away from the longitudinal axis, and the drum interior surface facing toward the longitudinal axis and including first and second open ends and at least one protrusion disposed apart from the first and second open ends. A flange includes a flange interior surface disposed in the first open end, a flange exterior surface disposed outside of the first open end, a flange side surface connecting the flange interior and exterior surfaces, and at least one receiving portion. The at least one protrusion is disposed in the at least one receiving portion.

35 Claims, 4 Drawing Sheets

COUPLING ARRANGEMENT INCLUDING DRUM AND FLANGE

CROSS-REFERENCE TO RELATED APPLICATIONS

This application claims the benefit of priority to U.S. provisional application No. 60/384,107, to Himes et al., filed May 31, 2002, the disclosure of which is incorporated by reference herein in its entirety.

BACKGROUND OF THE INVENTION

1. Field of the Invention

The present invention relates to a coupling arrangement including an optical photo-conductive (OPC) drum and a flange (e.g., a driving flange and/or a driven flange) in an electro-photographic (EP) machine, and more particularly to a coupling arrangement including a protrusion of the OPC drum disposed in a receiving portion of the flange.

2. Discussion of the Related Art

In a known electro-photographic (EP) machine, such as a photocopier, a laser printer, and a facsimile, a known process cartridge is removably mounted to a known main assembly.

The main assembly of the EP machine generally includes, among other components, a housing, a control panel disposed within the housing for controlling an image forming process, an electronic control system that is operated by the control panel, a motor that is controlled by the control system, a gear train that is driven by the motor, and electrical contacts for delivering power to the process cartridge that is inserted into and retained within grooves or channels formed in opposing side walls of the housing. The main assembly generally also includes an optical projection system and a central processor that controls a sequence and a timing of the optical projection system during a known image forming operation.

The process cartridge generally includes, among other components, an optical photo-conductive (OPC) drum, and a driving gear for driving one or more components of the process cartridge, such as a charging device, a developing device, and a cleaning device.

During the known image forming operation, the OPC drum undergoes a charging portion and a discharging portion of a charging/discharging cycle to ultimately create a developer image (e.g., a toner image) on a recording material (e.g., a sheet of paper, a transparent sheet, etc.). Briefly, during the charging portion of the charging/discharging cycle, the charging device uniformly charges an exterior surface of the OPC drum. The optical projection system projects image containing information in the form of a laser light to selectively discharge a portion of the exterior surface of the OPC drum, thereby forming a latent image on the OPC drum. The developing device applies a developer (e.g., a toner) to the partially charged exterior surface of the OPC drum. The developer is electro-statically attracted to the charged areas of the OPC drum, thereby forming the developer image. The developer image is then transferred from the exterior surface of the OPC drum to the recording material.

In the known process cartridge, the exterior surface of the OPC drum is coated with an electrically resistive coating to improve a quality of the image produced during the image forming process. Examples of known electrically resistive coatings include hard anodization with aluminum oxide ($Al_2O_3$) and oxidized surfaces. Generally, during a coating process, the OPC drum is submerged in the electrically resistive coating, such that an interior surface of the OPC drum, as well as the exterior surface, is coated with the electrically resistive coating.

It is known that the coated interior surface of the OPC drum must be sufficiently grounded for the OPC drum to undergo the required discharging portion of the charging/discharging cycle. In a known grounding or earthing arrangement, a grounding plate is disposed beneath the driving gear and within an interior portion of the OPC drum. The grounding plate includes a plurality of first radially extending projections that contact the interior surface of the OPC drum. To satisfactorily ground the OPC drum with the coated interior surface, the electrically resistive coating must be removed from a contact area of the interior surface through a separate and additional process (i.e., a process after the coating of the OPC drum), such that the first projections can achieve electrical connection with the interior surface of the OPC drum. An example of a known process for removing the electrically resistive coating includes a laser scribing operation. The grounding plate also includes a plurality of second radially extending projections that contact an electrically conductive shaft extending through the driving gear.

Thus, during assembly of the known process cartridge, the grounding plate is aligned with and inserted into the OPC drum, such that the first projections of the grounding plate achieve electrical connection with the contact areas of the OPC drum. The driving gear is then secured to the OPC drum by known securing means, thereby preventing relative movement and rotation, and preventing disassembly, among the OPC drum, the driving gear, and the grounding plate. Examples of securing means include an adhesive and a press fit arrangement. The electrically conductive shaft extends through the driving gear, and achieves electrical connection with the second projections of the grounding plate. By these arrangements, the OPC drum is sufficiently grounded through the grounding plate and the electrically conductive shaft.

However, the known OPC drum assembly suffers from a number of disadvantages. For example, during curing of the adhesive, care must be taken to maintain precise alignment and to prevent relative rotation and movement of the driving gear and the grounding plate relative to the OPC drum. Failure to maintain precise alignment may result in failure to achieve sufficient grounding of the OPC drum. The requirement to maintain precise alignment acts as an impediment to an automatic assembly of the OPC drum assembly. Further, the inadvertent use of an undesirably large volume of adhesive may result in adhesive flow into undesired portions of the known OPC drum assembly, and may degrade performance of the OPC drum assembly. The use of an undesirably small volume of adhesive may result in poor bond formation and inadequate bond strength between the OPC drum and the driving gear, and may reduce a useful life of the OPC drum assembly. Further, the press fit arrangement requires a relatively high degree of mechanical precision of each of the OPC drum and the driving gear (e.g., tolerances related to cylindricity of the driving gear and the OPC drum) to achieve satisfactory securing of the OPC drum and the driving gear. Such disadvantages increase a manufacturing time and/or a manufacturing cost of the known OPC drum assembly.

SUMMARY OF THE INVENTION

The present invention provides a coupling arrangement having an optical photo-conductive drum including drum exterior and interior surfaces surrounding and extending along a longitudinal axis, the drum exterior surface facing away from the longitudinal axis, and the drum interior surface facing toward the longitudinal axis and including first and second open ends and at least one protrusion disposed apart from the first and second open ends. A flange includes a flange interior surface disposed in the first open end, a flange exterior surface disposed outside of the first open end, a flange side surface connecting the flange interior and exterior surfaces, and at least one receiving portion. The at least one protrusion is disposed in the at least one receiving portion.

The present invention further provides an optical photo-conductive drum. A drum exterior surface surrounds and extends along a longitudinal axis, the drum exterior surface facing away from the longitudinal axis. A drum interior surface surrounds and extends along the longitudinal axis, the drum interior surface facing toward the longitudinal axis and including first and second open ends. At least one protrusion is disposed apart from the first and second open ends.

The present invention further provides a process cartridge adapted to be removably mounted on an electro-photographic machine including a coupling arrangement. The coupling arrangement has an optical photo-conductive drum including drum exterior and interior surfaces surrounding and extending along a longitudinal axis, the drum exterior surface facing away from the longitudinal axis, and the drum interior surface facing toward the longitudinal axis and including first and second open ends and at least one protrusion disposed apart from the first and second open ends. A flange includes a flange interior surface disposed in the first open end, a flange exterior surface disposed outside of the first open end, a flange side surface connecting the flange interior and exterior surfaces, and at least one receiving portion. The at least one protrusion is disposed in the at least one receiving portion.

The present invention further provides an electro-photographic machine, including a main portion and a coupling arrangement removably mounted on the main portion. The coupling arrangement has an optical photo-conductive drum including drum exterior and interior surfaces surrounding and extending along a longitudinal axis, the drum exterior surface facing away from the longitudinal axis, and the drum interior surface facing toward the longitudinal axis and including first and second open ends and at least one protrusion disposed apart from the first and second open ends. A flange includes a flange interior surface disposed in the first open end, a flange exterior surface disposed outside of the first open end, a flange side surface connecting the flange interior and exterior surfaces, and at least one receiving portion. The at least one protrusion is disposed in the at least one receiving portion.

The present invention further provides a coupling arrangement having an optical photo-conductive drum including drum exterior and interior surfaces surrounding and extending along a longitudinal axis, the drum exterior surface facing away from the longitudinal axis, and the drum interior surface facing toward the longitudinal axis and including first and second open ends and a first structure for securing disposed apart from the first and second open ends. A flange includes a flange interior surface disposed in the first open end, a flange exterior surface disposed outside of the first open end, a flange side surface connecting the flange interior and exterior surfaces, and a second structure for securing. The first structure for securing is disposed in the second structure for securing.

The present invention further provides a method of assembling a coupling arrangement including an optical photo-conductive drum having a drum exterior surface and a drum interior surface including first and second open ends. The method includes inserting a flange including a receiving portion in the first open end, and forming a protrusion on the optical photo-conductive drum, the protrusion being received in the receiving portion.

The present invention still further provides a coupling arrangement produced by a method of assembling a coupling arrangement including an optical photo-conductive drum having a drum exterior surface and a drum interior surface including first and second open ends. The method includes inserting a flange including a receiving portion in the first open end, and forming a protrusion on the photo-conductive drum, the protrusion being received in the receiving portion.

BRIEF DESCRIPTION OF THE DRAWINGS

A more complete appreciation of the present invention, and many of the attendant advantages thereof, will be readily ascertained and/or obtained as the same becomes better understood by reference to the following detailed description when considered in connection with the accompanying drawings, wherein.

DETAILED DESCRIPTION OF THE PREFERRED EMBODIMENTS

Figure 1:
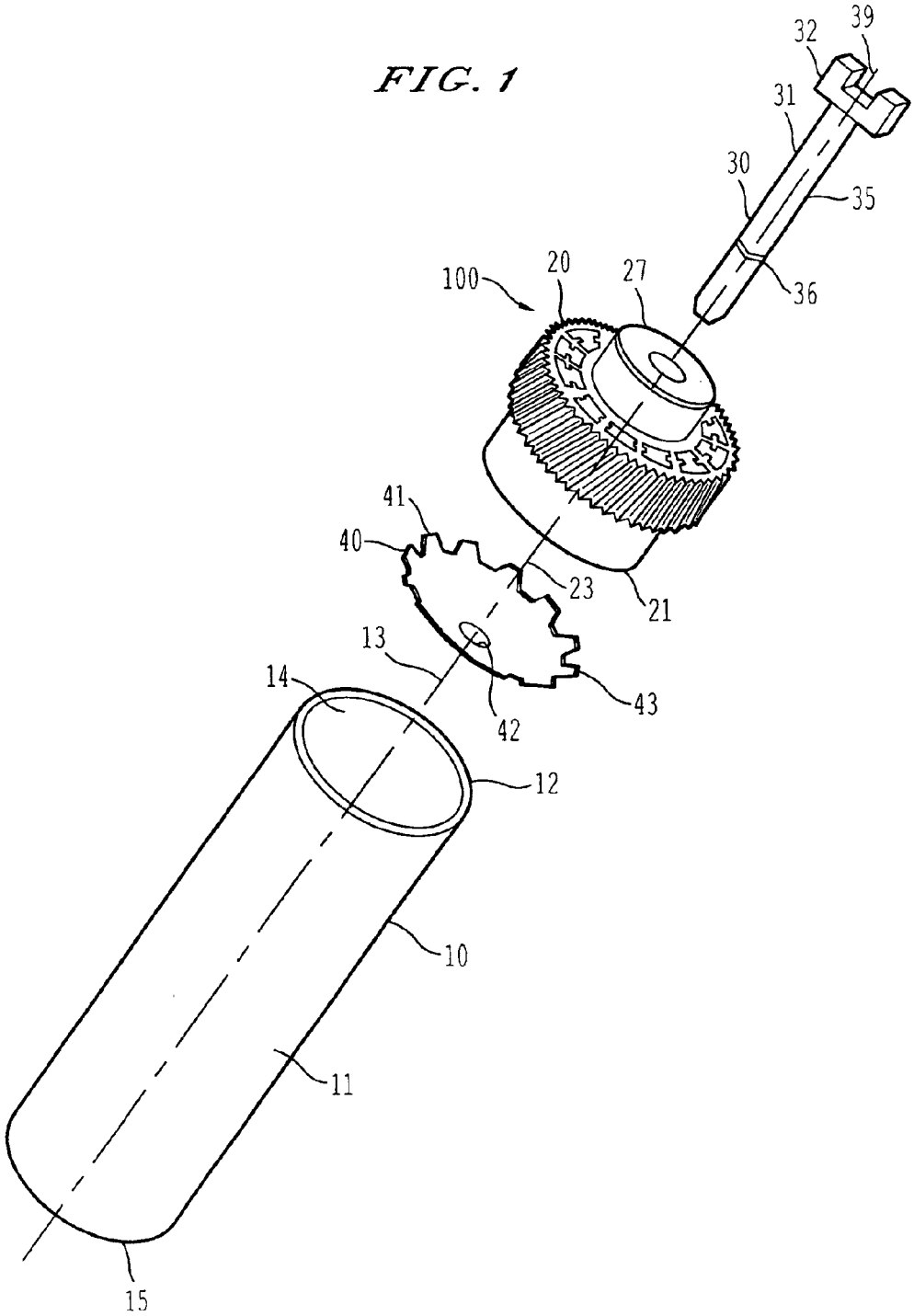
FIG. 1 shows an exploded isometric view of a coupling arrangement including an optical photo-conductive (OPC) drum and a flange according to the present invention.
Figure 2:
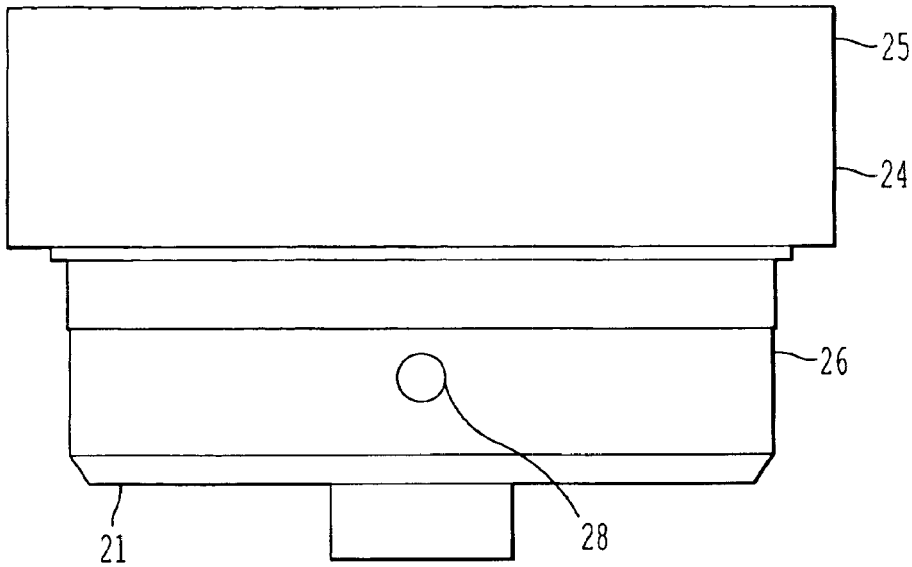
FIG. 2 shows an elevation view of the flange of FIG. 1.
Figure 3:
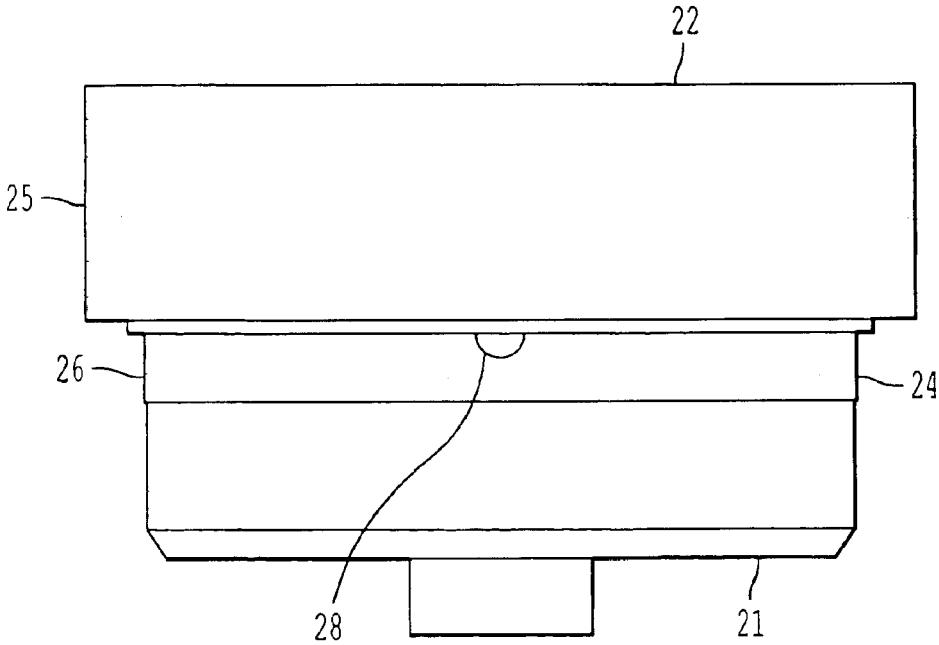
FIG. 3 shows an elevation view of another embodiment of a flange according to the present invention.

Examples of preferred embodiments of the present invention will now be described with reference to the drawings, wherein like reference numbers throughout the several views identify like and/or similar elements.

The figures show an example of a coupling arrangement that can include an optical photo-conductive (OPC) drum and a flange (e.g., a driving flange and/or a driven flange) of a process cartridge removably mounted to a main assembly of an electro-photographic (EP) machine.

In certain preferred embodiments of the present invention, the coupling arrangement has an OPC drum that includes drum exterior and interior surfaces surrounding and extending along a longitudinal axis, the drum exterior surface facing away from the longitudinal axis, and the drum interior surface facing toward the longitudinal axis and including first and second open ends and at least one protrusion disposed apart from the first and second open ends. The flange includes a flange interior surface disposed in the first open end, a flange exterior surface disposed outside of the first open end, a flange side surface connecting the flange interior and exterior surfaces, and at least one receiving portion. The at least one protrusion is disposed in the at least one receiving portion. By this arrangement, the OPC drum can be secured with and prevented from rotation and/or movement relative to the flange. The coupling arrangement can be secured without the use of additional securing means, such as an adhesive and/or a press fit arrangement. Further, the coupling arrangement can withstand an application of a predetermined axial and/or torsional force, such that material properties of the OPC drum and/or the flange can determine a strength of the coupling arrangement.

Specifically, as shown in the figures, a coupling arrangement 100 according to the present invention can include, among other components, an optical photo-conductive (OPC) drum 10, a flange (e.g., a driving flange and/or a driven flange) 20, a grounding shaft 30, and a grounding plate 40, examples of which are discussed below.

During an image forming process, an electro-static latent image and a subsequent developer image (i.e., a toner image) can be formed on the OPC drum 10 for transfer to a recording material (e.g., a sheet of paper, a transparent sheet, etc.). Thus, although the drawings show certain preferred embodiments of the OPC drum 10, it is to be understood that the OPC drum 10 can be of any type on which an electrostatic latent image and/or a developer image can be formed.

As shown in the figures, the OPC drum 10 can include a drum exterior surface 11 and a drum interior surface 12, both of which can extend about along, and can be about coaxial with, a longitudinal axis 13. The drum exterior surface 11 can face away from the longitudinal axis 13, and the drum interior surface 12 can face toward the longitudinal axis 13. By this arrangement, the drum exterior and interior surfaces 11 and 12 can define the OPC drum 10, such that the OPC drum 10 can be about cylindrical in shape. The drum interior surface 12 can include first and second open ends 14 and 15, respectively.

Figure 4:
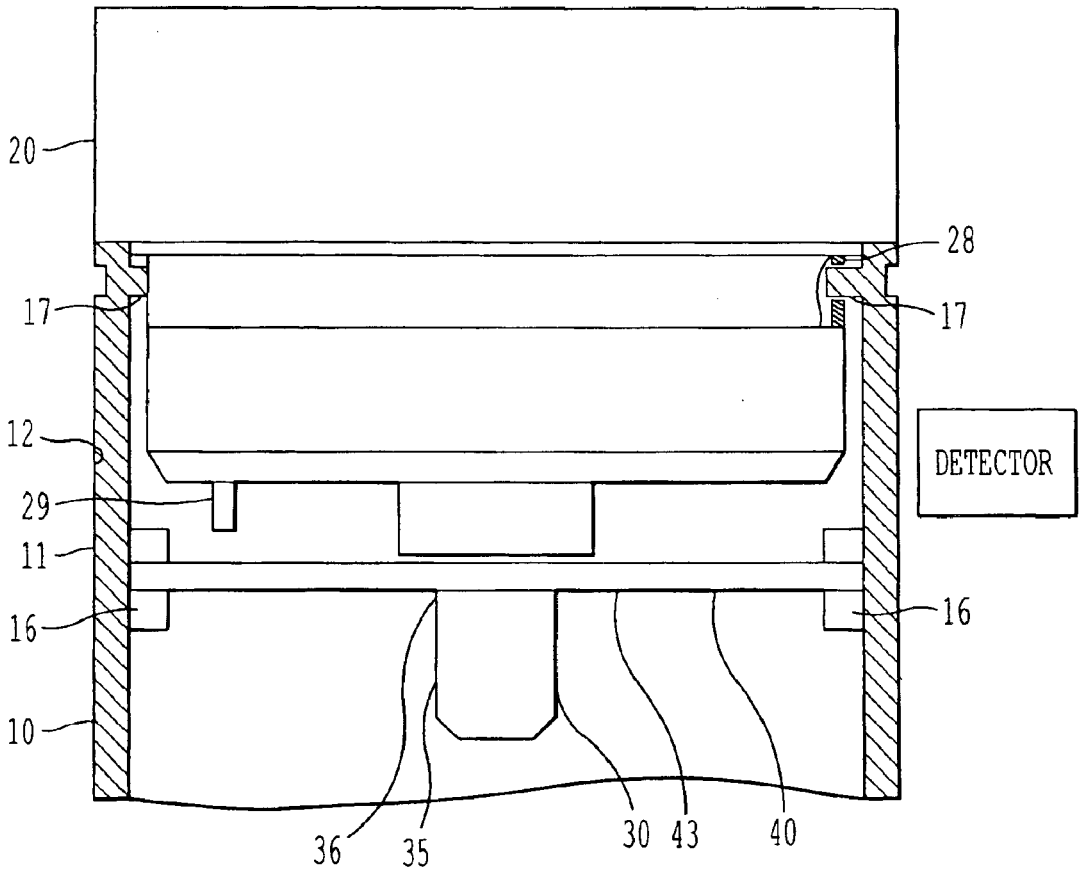
FIG. 4 shows an elevation partial cross-sectional view of the coupling arrangement of FIG. 1.

At least one of the drum exterior surface 11 and the drum interior surface 12 can include an electrically resistive coating, such as a hard anodization with aluminum oxide ($Al_2O_3$) and/or oxidized surfaces. The electrically resistive coating can be formed on the drum exterior surface 11 to improve a quality of the image formed thereon in the image forming process, and the electrically resistive coating can be formed on the drum interior surface 12 as a consequence of the formation of the coating on the drum exterior surface 11 (e.g., by submerging the OPC drum 10 into the coating during a known coating process). The electrically resistive coating can be sufficiently electrically resistive so as to impede a discharging portion of a charging/discharging cycle of the OPC drum 10, such that removal of a portion of the electrically resistive coating from at least one contact area 16 of the drum interior surface 12 can improve electrical connection therewith, and can achieve the image formed in the image forming process. The electrically resistive coating can be removed from the at least one contact area 16 (FIG. 4) of the drum interior surface 12 by at least one known resistive coating removal method, such that the OPC drum 10 can be grounded. In a preferred embodiment of the invention, the electrically resistive coating can be removed from two contact areas 16 of the drum interior surface 12, and can be removed by a laser scribing operation. The OPC drum 10 can be of any material that can be used in the formation of the latent image and/or in the formation of the developer image, such as aluminum.

The OPC drum 10 can include at least one protrusion 17 (FIG. 4) to be disposed in a receiving portion of the flange 20, and the at least one protrusion 17 can be disposed apart from the first and second open ends 14 and 15 of the OPC drum 10. By this arrangement, the OPC drum 10 can be secured with and can be prevented from rotation and/or movement relative to the flange 20. The coupling arrangement 100 can be secured without the use of additional securing means, such as an adhesive and/or a press fit arrangement between the OPC drum 10 and the flange 20. Further, the coupling arrangement 100 can withstand an application of a predetermined axial and/or torsional force, such that material properties of the OPC drum 10 and/or the flange 20 can determine a strength of the coupling arrangement 100. Specifically, because portions of the OPC drum 10 and the flange 20 can be used to connect the OPC drum 10 and the flange 20, the weaker of the respective portions of the OPC drum 11 and the flange 20 defines the strength of the coupling arrangement 100.

In a preferred embodiment of the invention, the at least one protrusion 17 can have a shape that can be a consequence of methods of assembling the coupling arrangement 100. Preferably, the at least one protrusion 17 can have a shape that includes one or more of an arc, an ellipse, a circle, and a polygon (such as a triangle, a rectangle, a square, a diamond, a pentagon, a hexagon, a heptagon, an octagon, etc.), as well as combinations of these and other shapes. Thus, although the drawings show certain preferred shapes of the at least one protrusion 17, it is to be understood that the at least one protrusion 17 can be of any shape, so long as the at least one protrusion 17 can be disposed in a receiving portion of the flange 20.

In a preferred embodiment of the invention, the at least one protrusion 17 can include a plurality of protrusions 17 that are spaced at a variety of locations on the drum interior surface 12, and more preferably can include two (2) protrusions 17 that are about equally spaced about the drum interior surface 12. Further, the plurality of protrusions 17 can correspond to a plurality of receiving portions of the flange 20. Thus, in a preferred embodiment of the invention, the OPC drum 10 can include two (2) protrusions 17 that are about equally spaced about the drum interior surface 12 and that correspond to two (2) receiving portions on the flange 20.

Further details of the at least one protrusion 17 are discussed below with reference to methods of assembling the coupling arrangement 100.

As shown in the drawings, the flange 20 (e.g., a driving flange that can be used to drive at least one component of at least one of a process cartridge that includes the coupling arrangement 100 and the EP machine and/or a driven flange) can include a flange interior surface 21 that can be disposed within the first open end 14 of the OPC drum 10, and can include a flange exterior surface 22 that can be disposed opposite to the flange interior surface 21 and outside of the first open end 14. The flange interior and exterior surfaces 21 and 22 can be about parallel to one another and can be about perpendicular to a longitudinal axis 23 of the flange 20, and the longitudinal axis 23 can be about perpendicular to the longitudinal axis 13 of the OPC drum 10 when the flange 20 is inserted into the first open end 14 of the OPC drum 10.

The flange interior surface 21 can include one or more grounding alignment posts (not shown) corresponding to one or more alignment voids in the grounding plate 40 to aid in assembly of the coupling arrangement 100, and more particularly to aid in the insertion of the grounding plate 40 with the flange 20 into the OPC drum 10. The grounding alignment posts of the flange 20 and the corresponding alignment voids of the grounding plate 40 can be of a known type having an "x" or cross-shaped cross-section. The flange interior surface 21 can include a plurality of grounding alignment posts, and can include at least four (4) grounding alignment posts that correspond to at least four (4) alignment voids in the grounding plate 40.

A flange side surface 24 can extend between the flange interior and exterior surfaces 21 and 22 and can be about perpendicular to the longitudinal axis 23. The flange side surface 24 can include a first profile 25 disposed adjacent to the flange exterior surface 22 and can include a second profile 26 disposed adjacent to the flange interior surface 21, the first and second profiles 25 and 26 extending along the longitudinal axis 23. The first profile 25 can include one or more geared driving teeth for driving at least one component of at least one of the process cartridge and the EP machine. The second profile 26 can be disposed within the OPC drum 10, and can be sized to achieve an interference fit with the drum interior surface 12 of the OPC drum 10. The first profile 25 can have a maximum diameter that is equal to or greater than a maximum diameter of the second profile 26, such that the flange side surface 24 can have a stepped profile. By this arrangement, when the flange interior surface 21 is inserted into the OPC drum 10, a step of the flange side surface 24 can abut an end of the first open end 14 of the OPC drum 10, such that complete insertion of the flange 20 into the OPC drum 10 can be achieved.

The flange 20 can include a grounding shaft opening 27 that extends between the flange interior surface 21 and the flange exterior surface 22 to communicate an interior and an exterior of the OPC drum 10. The grounding shaft opening 27 can be sized to achieve an interference fit with one or more surfaces of the grounding shaft 30. The grounding shaft opening 27 can be about concentric with, and can be about perpendicular to, the longitudinal axis 23 of the flange 20. The flange 20 can be of any material that can be used to drive at least one component of at least one of the process cartridge and the EP machine during the image forming process, such as an engineering plastic resin that can include at least one of a thermoplastic and/or a thermoset. Examples of such plastics can include polyacetals, nylons, and/or polyesters.

The flange 20 can include at least one receiving portion 28 to receive the at least one protrusion 17 of the OPC drum 10. By this arrangement, the OPC drum 10 can be secured with and can be prevented from rotation and/or movement relative to the flange 20. The coupling arrangement 100 can be secured without the use of additional securing means, such as an adhesive and/or a press fit arrangement between the OPC drum 10 and the flange 20. Further, the coupling arrangement 100 can withstand an application of a predetermined axial and/or torsional force, such that material properties of the OPC drum 10 and/or the flange 20 can determine a strength of the coupling arrangement 100. Specifically, because portions of the OPC drum 10 and the flange 20 can be used to connect the OPC drum 10 and the flange 20, a weaker of the respective portions of the OPC drum 10 and the flange 20 can define the strength of the coupling arrangement 100.

In a preferred embodiment of the invention, the at least one receiving portion 28 can have a shape that corresponds to the shape of the at least one protrusion 17 as a consequence of methods of assembling the coupling arrangement 100. Preferably, the at least one receiving portion 28 can have a shape that includes one or more of an arc, an ellipse, a circle, and an equivalent arcuate shape, and a polygon (such as a triangle, a rectangle, a square, a diamond, a pentagon, a hexagon, a heptagon, an octagon, etc.), as well as combinations of these and other shapes. Thus, although the drawings show certain preferred shapes of the at least one receiving portion 28, it is to be understood that the at least one receiving portion 28 can be of any shape, so long as the at least one receiving portion 28 can receive the at least one protrusion 17 of the OPC drum 10. Further, the at least one receiving portion 28 can be formed during an initial manufacturing process of the flange 20 (e.g., during an injection molding of the flange 20), and/or can be formed after an initial manufacturing process of the flange 20 (e.g., by machining after the flange 20 is substantially otherwise completed).

The at least one receiving portion 28 can be disposed on the flange side surface 24 of the flange 20. In a preferred embodiment of the invention, the at least one receiving portion 28 can be disposed on the second profile 26 of the flange side surface 24 that can be disposed in the first open end 14 of the OPC drum 10. Although the drawings show certain preferred locations of the at least one receiving portion 28, it is to be understood that the at least one receiving portion 28 can be disposed at any position along the second profile 26, including at a position that can be adjacent to an edge of the first profile 25 of the flange side surface 24, and/or at a position that can be disposed apart from an edge of the first profile 25.

In a preferred embodiment of the invention, the at least one receiving portion 28 can include a plurality of receiving portions 28 that are spaced at a variety of locations on second profile 26, and more preferably can include two (2) receiving portions 28 that are about equally spaced on the second profile 26. Further, the plurality of receiving portions 28 can correspond to the plurality of protrusions 17 of the OPC drum 10. Thus, in a preferred embodiment of the invention, the flange 20 can include two (2) receiving portions 28 that are about equally spaced on the second profile 26 and that correspond to two (2) protrusions 17 of the OPC drum 10. Further, one or more of the at least one protrusion 17 (e.g., either or both of the protrusions 17) can be disposed in the at least one receiving portions 28 (e.g., either of both of the receiving portions 28) such that the protrusion(s) 17 cannot be easily removed from the receiving portion(s) 28 after insertion thereinto.

In a preferred embodiment of the invention, the at least one receiving portion 28 can be in the form of at least one blind void (i.e., a void closed at one end).

Further details of the at least one receiving portion 28 are discussed below with reference to methods of assembling the coupling arrangement 100.

The flange 20 can optionally include an adhesive channel (not shown) that can be used in conjunction with the receiving portion 28 to secure with the OPC drum 10. The adhesive channel can be disposed on the flange side surface 24 of the flange 20, and can be disposed on the second profile 26 of the flange side surface 24 that can be disposed in the first open end 14 of the OPC drum 10. Further, it is to be understood that the adhesive channel can be disposed at any position along the second profile 26, including at a position that can be adjacent to an edge of the first profile 25 of the flange side surface 24, and/or at a position that can be disposed apart from an edge of the first profile 25.

As shown in the drawings, the grounding shaft 30 can include a first end 31 and can include a second end 35 extending about along an axis 39. At least one of the first end 31 and the second end 35 can include one or more faces, such that at least one of the first end 31 and the second end 35 can have a polygonal cross-section.

The first end 31 can include a driving engagement 32 for driving the OPC drum 10 during the image forming process. The driving engagement 32 can be sized, shaped, oriented, and/or otherwise disposed such that the grounding shaft 30 can be driven during the image forming process. Thus, although the drawings show certain preferred shapes of the driving engagement 32, it is to be understood that the driving engagement 32 can be of any shape, so long as the driving engagement 32 can be used to drive the OPC drum 10. The second end 35 can include a contact portion 36 that can contact a portion of the grounding plate 40 to achieve electrical connection therewith.

As shown in the drawings, the grounding plate 40 can include one or more outwardly extending contacts 41 to achieve electrical connection with the one or more contact areas 16 of the OPC drum 10, and can include one or more inwardly extending contacts 42 to achieve electrical connection with the grounding shaft 30.

The outwardly extending contacts 41 can be sized, shaped, and/or oriented, and the number of the contacts 41 can be chosen, such that the desired electrical connection can be achieved with the one or more contact areas 16 of the OPC drum 10.

As discussed above, the inwardly extending contacts 42 can contact the contact portion 36 of the grounding shaft 30 inserted through the grounding shaft opening 27 of the flange 20. Similar to the contacts 41, one or more attributes of the contacts 42 can be chosen such that the desired electrical connection can be achieved between the grounding plate 40 and the grounding shaft 30.

Further, one or more of the attributes of the contacts 42 can be chosen such that an interference fit can be achieved between the grounding plate 40 and the grounding shaft 30. Specifically, in certain preferred embodiments of the present invention, the inwardly extending contacts 42 can achieve an interference fit with the contact portion 36 of the grounding shaft 30.

The grounding plate 40 can also include one or more alignment voids (not shown) corresponding to the one or more grounding alignment posts of the flange 20 to aid in assembly of the coupling arrangement 100. Preferably, a center portion 43 of the grounding plate 40 can include a plurality of alignment voids having an "x" or cross-shaped cross-section that corresponds to the cross-section of the grounding alignment posts of the flange 20. The grounding plate 40 can also include a variety of materials that can achieve the desired electrical connection. Examples of such materials can include a metal or a metal coating such as copper, iron, aluminum, and/or phosphor bronze.

Thus, by the above arrangement, grounding of the OPC drum 10 (i.e., grounding of the grounding plate 40 with the drum interior surface 12 of the OPC drum 10, and grounding of the grounding plate 40 with the grounding shaft 30) can be achieved.

Methods of assembling the coupling arrangement 100 according to the present invention can include inserting the flange 20 having the at least one receiving portion 27 in the first open end 14 of the OPC drum 10. The at least one protrusion 17 can be formed on the OPC drum 10, such that the at least one protrusion 17 can be received in the corresponding receiving portion 28 of the flange 20.

The at least one protrusion 17 can be formed by a punching operation, wherein the OPC drum 10 can be punched to form the at least one protrusion 17. In certain preferred embodiments of the invention, one or more of the drum exterior and interior surfaces 11 and 12 can be punched to plastically deform at least the drum interior surface 12 and subsequently to form the at least one protrusion 17, and/or can be punched through the drum exterior and interior surfaces 11 and 12 to form the at least one protrusion 17. One or more of the drum exterior and interior surfaces 11 and 12 can be punched with a tool having a shape corresponding to a shape of the at least one receiving portion 28 of the flange 20.

Methods of assembling the coupling arrangement 100 can include orienting the flange 20, and/or orienting the receiving portion 28 of the flange 20, to a predetermined position. In certain preferred embodiments of the invention, the flange 20 can include a guide portion 29, with which the flange 20 and the receiving portion 28 are oriented with respect to. Preferably, the guide portion 29 can include one or more posts that can be detected by a detector, and more preferably that can be detected by a mechanical detector (such that the guide portion 29 acts as a mechanical stop) and/or by a light detector (such as a laser beam). Thus, it is understood that the method of assembling the coupling arrangement 100 can be automated, and can be performed by an apparatus that can orient the at least one receiving portion 28 of the flange 20 to a predetermined position, and form the at least one protrusion 17 in the OPC drum 10, such that the at least one protrusion 17 of the OPC drum 10 can be disposed in the at least one receiving portion 28 of the flange 20.

Figure 5:
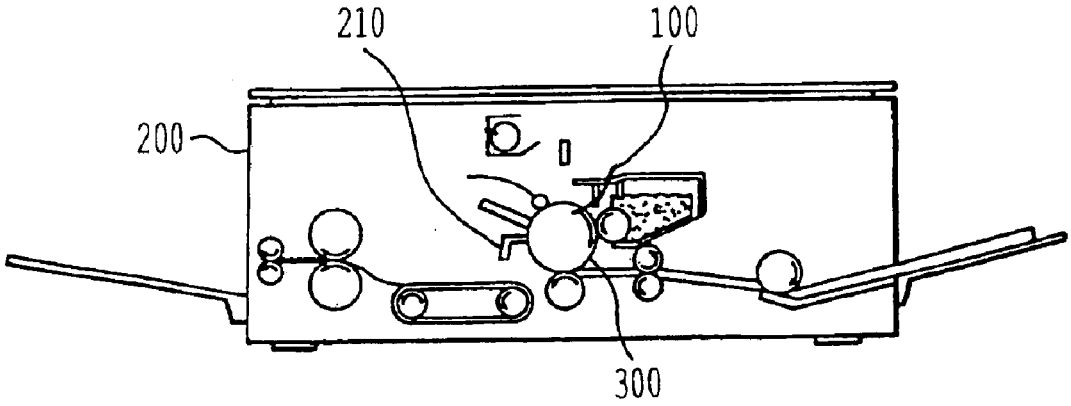
FIG. 5 shows a cross-sectional view of a photocopier including a process cartridge with the coupling arrangement of FIG. 1.

As shown in FIG. 5, the assembled coupling arrangement 100 can be disposed in an electro-photographic machine 200, such as a photocopier. In a preferred embodiment of the invention, the coupling arrangement 100 can be disposed in a process cartridge 300 (e.g., the coupling arrangement 100 and a flange for connection with the electro-photographic machine 200) adapted to be removably mounted to the electro-photographic machine 200, and more specifically can be configured to mount to a main portion 210 of the electro-photographic machine.

What is claimed is:

1. A coupling arrangement, comprising:

an optical photo-conductive drum including drum exterior and interior surfaces surrounding and extending along a longitudinal axis, the drum exterior surface facing away from the longitudinal axis, and the drum interior surface facing toward the longitudinal axis and including first and second open ends and at least one protrusion disposed apart from the first and second open ends; and a flange including a flange interior surface disposed in the first open end, a flange exterior surface disposed outside of the first open end, a flange side surface connecting the flange interior and exterior surfaces, and at least one receiving portion, wherein the at least one protrusion is formed in the at least one receiving portion.

2. The coupling arrangement according to claim 1, wherein the at least one protrusion comprises a plurality of protrusions, and the at least one receiving portion comprises a plurality of receiving portions.

3. The coupling arrangement according to claim 2, wherein a number of the plurality of protrusions corresponds to a number of the plurality of receiving portions.

4. The coupling arrangement according to claim 3, wherein the plurality of protrusions comprises two protrusions and the plurality of receiving portions comprises two receiving portions.

5. The coupling arrangement according to claim 1, wherein the at least one receiving portion is disposed in the flange side surface.

6. The coupling arrangement according to claim 5, wherein the flange side surface comprises first and second profiles extending along the longitudinal axis, the first profile having a first diameter and disposed in the first open end, and the second profile having a second diameter greater than the first diameter and disposed outside of the first open end, and the at least one receiving portion is disposed on the first profile.

7. The coupling arrangement according to claim 6, wherein the at least one protrusion comprises a plurality of protrusions and the at least one receiving portion comprises a plurality of receiving portions.

8. The coupling arrangement according to claim 6, wherein the at least one receiving portion is disposed on the first profile adjacent an edge of the second profile.

9. The coupling arrangement according to claim 8, wherein the at least one protrusion comprises a plurality of protrusions and the at least one receiving portion comprises a plurality of receiving portions.

10. The coupling arrangement according to claim 6, wherein the at least one receiving portion is disposed on the first profile disposed apart from an edge of the second profile.

11. The coupling arrangement according to claim 10, wherein the at least one protrusion comprises a plurality of protrusions and the at least one receiving portion comprises a plurality of receiving portions.

12. The coupling arrangement according to claim 11, wherein a shape of the at least one protrusion corresponds to a shape of the at least one receiving portion.

13. The coupling arrangement according to claim 12, wherein the shape of the at least one protrusion comprises an arc.

14. The coupling arrangement according to claim 12, wherein the shape of the at least one protrusion comprises an ellipse.

15. The coupling arrangement according to claim 12, wherein the shape of the at least one protrusion comprises a circle.

16. The coupling arrangement according to claim 1, further comprising:

a grounding plate disposed in the first open end and including an outwardly extending contact contacting the drum interior surface to achieve electrical connection with the drum interior surface; and a grounding shaft disposed through a portion of the flange to achieve electrical connection with the grounding plate.

17. The coupling arrangement according to claim 16, wherein the grounding plate includes at least one outwardly extending contact to achieve electrical connection with the drum interior surface and at least one inwardly extending contact to achieve electrical connection with the grounding shaft.

18. A process cartridge adapted to be removably mounted on an electro-photographic machine, comprising:

the coupling arrangement according to claim 1.

19. An electro-photographic machine, comprising:

a main portion; and the coupling arrangement according to claim 1 removably mounted on the main portion.

20. A coupling arrangement, comprising:

an optical photo-conductive drum including drum exterior and interior surfaces surrounding and extending along a longitudinal axis, the drum exterior surface facing away from the longitudinal axis, and the drum interior surface facing toward the longitudinal axis and including first and second open ends and a first means for securing disposed apart from the first and second open ends; and a flange including a flange interior surface disposed in the first open end, a flange exterior surface disposed outside of the first open end, a flange side surface connecting the flange interior and exterior surfaces, and a second means for securing, wherein the first means for securing is formed in the second means for securing.

21. A method of assembling a coupling arrangement including an optical photo-conductive drum having a drum exterior surface and a drum interior surface including first and second open ends, the method comprising:

inserting a flange including a receiving portion in the first open end; and forming a protrusion on the optical photo-conductive drum, the protrusion being received in the receiving portion.

22. The method according to claim 21 wherein forming comprises punching the photo-conductive drum to form the protrusion.

23. The method according to claim 22, wherein forming comprises punching the drum exterior and interior surfaces to plastically deform the surfaces and to form the protrusion.

24. The method according to claim 22, wherein forming comprises punching through the drum exterior and interior surfaces to form the protrusion.

25. The method according to claim 22, wherein forming comprises punching the drum exterior and interior surfaces with a punch having a shape corresponding to a shape of the receiving portion.

26. The method according to claim 21, further comprising:

orienting the flange and the receiving portion to a predetermined position.

27. The method according to claim 26, wherein orienting comprises orienting the flange with respect to a guide portion of the flange.

28. The method according to claim 27, wherein the guide portion comprises a post extending from the flange.

29. The method according to claim 28, further comprising:

detecting a position of the post with at least one of a mechanical detector and a light detector.

30. The method according to claim 29, wherein the light detector comprises a laser.

31. A coupling arrangement, comprising:

an optical photo-conductive drum including drum exterior and interior surfaces surrounding and extending along a longitudinal axis, the drum exterior surface facing away from the longitudinal axis, and the drum interior surface facing toward the longitudinal axis and including first and second open ends and at least one protrusion disposed apart from the first and second open ends; and a flange including a flange interior surface disposed in the first open end, a flange exterior surface disposed outside of the first open end, a flange side surface connecting the flange interior and exterior surfaces, and at least one blind void, wherein the at least one protrusion is disposed in the at least one blind void.

32. A method of assembling a coupling arrangement, comprising:

inserting a flange including a receiving void in an open end of an optical photo-conductive drum; and deforming a portion of the optical photo-conductive drum to form a protrusion received in the void.

33. The method according to claim 32, wherein the void comprises a blind void.

34. The method according to claim 32, wherein deforming comprises deforming the portion of the optical photo-conductive drum by punching the portion of the drum from an exterior of the drum.

35. The method according to claim 32, wherein deforming comprises applying a force on an exterior of the drum to form the protrusion on an interior of the drum.

* * * * *